US005140640A

United States Patent [19]

Graupe et al.

[11] Patent Number: 5,140,640

[45] Date of Patent: Aug. 18, 1992

[54] NOISE CANCELLATION SYSTEM

[75] Inventors: Daniel Graupe, Highland Park; Adam J. Efron, Chicago, both of Ill.

[73] Assignee: The Board of Trustees of the University of Illinois, Urbana, Ill.

[21] Appl. No.: 567,269

[22] Filed: Aug. 14, 1990

[51] Int. Cl.[5] ..... G10K 11/16

[52] U.S. Cl. ..... 381/71

[58] Field of Search ..... 381/71, 94

[56] References Cited

U.S. PATENT DOCUMENTS

| | | | |
|---|---|---|---|
| 4,025,724 | 5/1977 | Davidson, Jr. et al. | 381/71 |
| 4,473,906 | 9/1984 | Warnaka et al. | 381/71 |
| 4,677,676 | 6/1987 | Eriksson | 381/71 |
| 4,677,677 | 6/1987 | Eriksson . | |

FOREIGN PATENT DOCUMENTS

| | | | |
|---|---|---|---|
| 2069280 | 8/1981 | United Kingdom | 381/71 |

OTHER PUBLICATIONS

Time Series Analysis, Identification and Adaptive Filtering; D. Graupe; 2nd Edition, R. E. Krieger Publishing Co., 1989 pp. 25–26, 55–90, 249–251.

The Selection and Application of an IIR Adaptive Filter For Use in Active Sound Attenuation; L. J. Eriksson, et al. IEEE Transactions on Acoustics, Speech and Signal Processing, vol. ASSP-35, No. 4, Apr. 1987, pp. 433–437.

Time Series Analysis, Forecasting and Control; G. E. P. Box and G. M. Jenkins Holden-Day Publisher, 1970; pp. 49–67 and 432–437.

Modern Control Theory; K. Ogata Prentice Hall, 1970; pp. 625–631.

Author: Wei Ren and P. R. Kumar—Title: Inter-noise 89; Date: Dec. 4–6, 1989; pp. 435 to 440.

*Primary Examiner*—Forester W. Isen

*Attorney, Agent, or Firm*—Marshall, O'Toole, Gerstein, Murray & Bicknell

[57] ABSTRACT

This disclosure relates to a self-adaptive noise cancellation system that may be employed in a noise environment at the vicinity of an acoustic noise source to produce noise signals denoted as anti-noise signals that are directed towards a geometric region of the same environment and which counter the first acoustic noise source thus rendering the geometric region relatively quiet. The system monitors the acoustic noise source to identify its signal parameters thus retrieving the noise parameters that are required for the device to tune itself in order to cope with variations in the parameters of the noise source and to adapt its own anti-noise output to keep adequate noise cancellation in said geometric region in the face of the changes in the characteristics of the noise source, such as changes in power or in frequency spectrum of the noise source.

12 Claims, 3 Drawing Sheets

NOISE CANCELLATION SYSTEM

FIELD AND BACKGROUND OF THE INVENTION

This invention relates to a system for cancelling or substantially reducing the noise from a noise source received, for example, by an individual.

It is well known that loud noise levels can make a person in the noise environment uncomfortable and, in fact, it can produce permanent damage to the ears of the person. This problem is particularly serious where a person or persons are required to work near noisy machinery.

Arrangements have been proposed in the past for cancelling some of the noise by producing an anti-noise signal which combines with the undesired noise. However, in the past such noise cancellation arrangements have been proposed mainly for well structured noise, that is, noise having a consistent, mostly deterministic noise pattern, and they have not been particularly effective.

It is a general object of the present invention to provide an improved system for substantially reducing the noise level in a noise environment, which is more effective than prior art proposals and is also effective with highly chaotic stochastic noise, and where the noise residual is driven towards a white noise sequence of difference between the original noise and the anti-noise.

SUMMARY OF THE INVENTION

Apparatus in accordance with the present invention is for use in a noise environment created by an acoustic noise source, and comprises a first microphone that picks up the noise that is to be cancelled. An acoustic anti-noise source is also positioned in the noise environment for providing acoustic noise cancellation signals. The same or a second microphone detects the noise cancellation signals which are combined with the output of the first microphone. Identifier means is also connected to the first microphone for identifying the parameters of the acoustic noise source, the identification being periodically updated to make the system adaptive and self adjusting. A noise cancellation circuit receives an identifier parameters set from the identification means and the combination of the signals from the two microphones, and produces a cancellation signal which is fed to the acoustic anti-noise source. The acoustic anti-noise combines with the noise from the source to substantially reduce the noise level in the environment.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
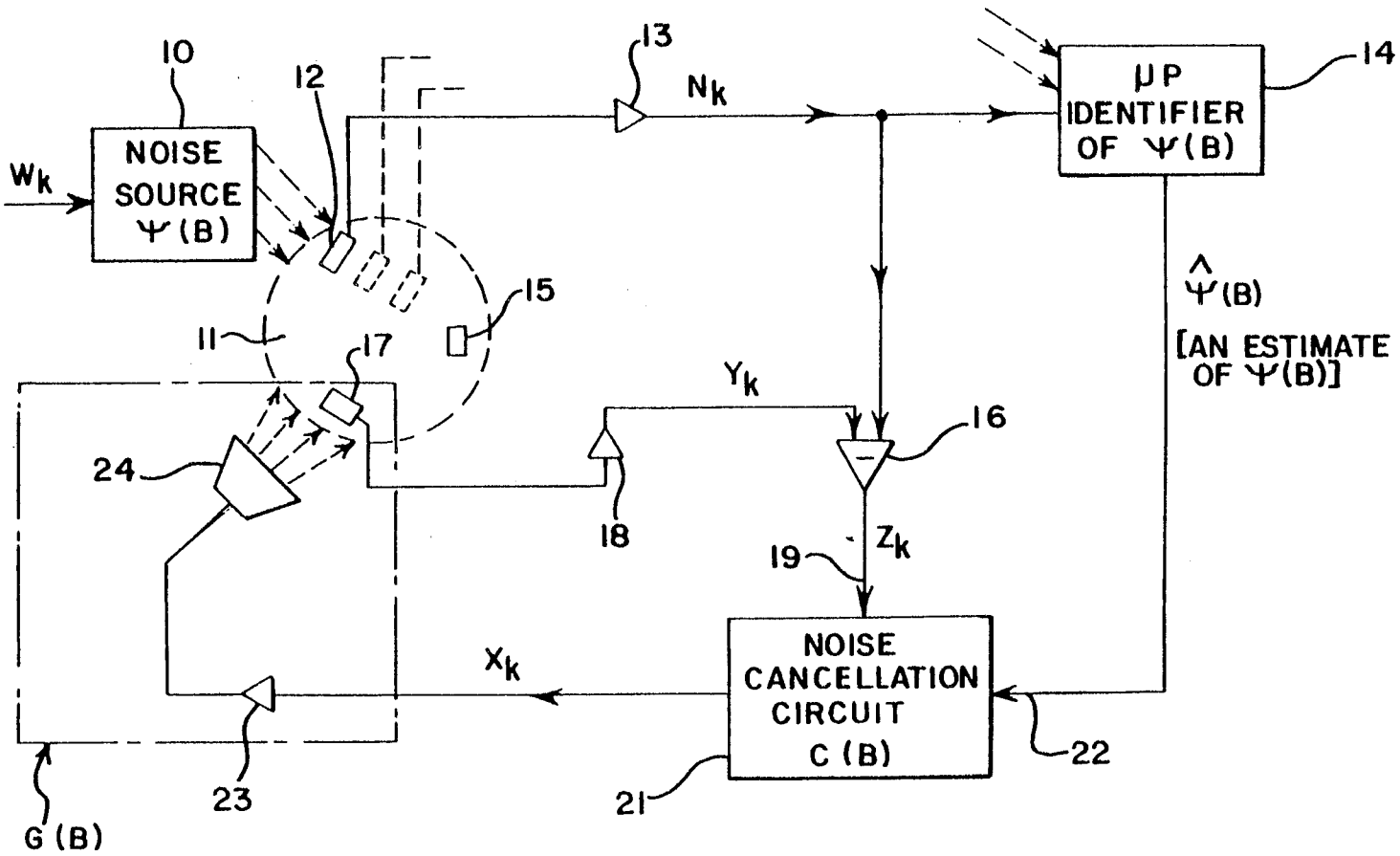
FIG. 1 is a schematic diagram of a noise cancellation system in accordance with the invention.

With reference first to FIG. 1, a noise source 10, such as a machine, produces noise in a noise environment 11 indicated by the dash lines. A first microphone 12 picks up the source noise which is amplified by an acoustic amplifier 13 and fed to a microprocessor ($\mu$p) 14 and to an amplifier 16. A second microphone 17 picks up the anti-noise signal, and its output is amplified by an acoustic amplifier 18 and fed to a second input of the amplifier 16 which combines the two input signals. In one form of the invention, the amplifier 16 produces a difference signal and in another form it produces a sum signal. The two input signals are combined in the appropriate phase to produce a combination signal (in this example it is a difference signal) at the amplifier 16 output which is fed to an input 19 of a noise cancellation circuit 21. The circuit 21 has a second input 22 which comprises parameters set produced by the identifier means 14, and its output is fed through an amplifier 23 to a loudspeaker 24 located adjacent the environment 11. The anti-noise output of the speaker 24 combines with the noise of the source 10, thereby producing a substantially noise-free environment 11. The microphone 17 is located to detect primarily the sound from the speaker 24.

In a specific example of the system, the source 10 may be a noisy machine and a person may be stationed in the environment 11 at approximately the position 15, facing the general direction of the source 10 and the speaker 24. The speaker 24 is thus at an angle of about 45° to the left and the source 10 is at an angle of about 45° to the right of the person. The anti-noise of the speaker 24 combines with the noise of the source 10, resulting in a substantially reduced noise level around the person 15.

Instead of a single microphone 12, an array of microphones, strategically located to pick up the noise that is to be cancelled, may be substituted for it. The output of the array would be fed to the identifier circuit 14 which would take the vector sum or the average, and then identify the parameters of the noise to be cancelled. Such an arrangement is indicated by the dashed lines in FIG. 1.

The noise source 10 whose noise is to be cancelled conforms with a general linear stochastic discrete time model given by the relation $$\Psi(B)w_k = n_k;\ \text{where } k=0,1,2,\ldots \tag{1}$$

$n_k$ being the noise of the noise source 10 as a function of discrete time $k=0,1,2,\ldots$, B being a unit delay operator such that $$B^i n_k = n_{k-i};\ i=\text{Integer} \tag{2}$$

$\Psi(B)$ being the discrete time transfer function in terms of operator B above and $w_k$ being a discrete time inaccessible white noise generation function which is not accessible to any measurement and which satisfies:

$$E\{w_k w_l\} = \begin{cases} W & k=l \\ 0 & k \neq l \end{cases};\quad E\{w_k\} = 0\ \forall k \tag{3}$$

k, l being integers and E denoting an expectation in probability theory, the symbol $\forall$ denoting "for all."

The above linear model for acoustic noise sources is known to those skilled in this art and is a well established model in the literature of filtering theory and time series analysis (see for example Graupe, D., *Time Series Analysis, Identification and Adaptive Filtering,* 2nd Edition, Krieger Pub. Co., Malabar, Fla. 1989; and Box G.E.P. and Jenkins, G. M., *Time Series Analysis, Forecasting and Control,* Holden Day Pub. Co., San Francisco, 1970). A possible realization of the self-adaptive active noise cancellation system, which is not the only realization, is given in schematic form in FIG. 3 where it comprises of elements G(B) and C(B) (see below) and the related microphones and amplifiers.

Figure 3:
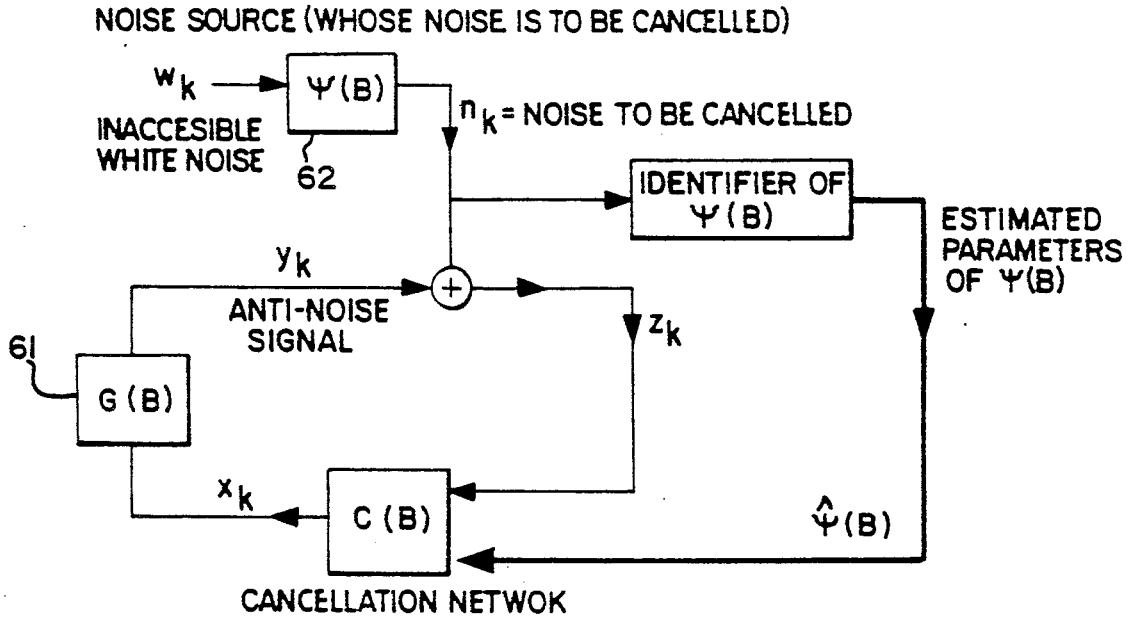
FIG. 3 is a block diagram showing a general form of the system.

In this analysis and with reference to FIG. 3, the symbol $z_k$ denotes the residual noise in the reduced-noise environment 11 created by the self-adaptive noise cancellation system of the present invention, whereas $y_k$ denotes the output of the self-adaptive noise cancellation system. C(B) denotes the transfer function (in operator B) of the noise cancellation circuit 21 and G(B) denotes the transfer function of the acoustic amplifier 23 and the transducer (speaker) 24 that transduce the electrical signal $x_k$ at the output of C(B) into an acoustic signal $y_k$, the latter being the anti-noise signal. In FIGS. 1 and 3, it is assumed that G(B) is known or pre-identified and is assumed to be fixed, but otherwise it can be identified from $x_k$ and $y_k$ as described in Chapter 5 of the D. Graupe book referred to above.

With regard to the development of C(B), the general form of C(B) is $C_0+C_1B+C_2B^2+\ldots+C_nB^n$; B being a unit delay operator. Other realizations for C(B) can be derived from the above realization to yield a polynomial ratio in operator B, such as $$C(B) = \frac{\alpha_0 + \alpha_1 B + \alpha_2 B^2 + \ldots}{\beta_0 + \beta_1 B + \beta_2 B^2 + \ldots} = C_0 + C_1 B + C_2 B^2 + \ldots \quad (4)$$

or its continuous time equivalents, as obtained via inverse Z-transform theory, noting that operator B satisfies $$Z = B^{-1} \quad (5)$$

Z being the z-transform operator.

Figure 4:
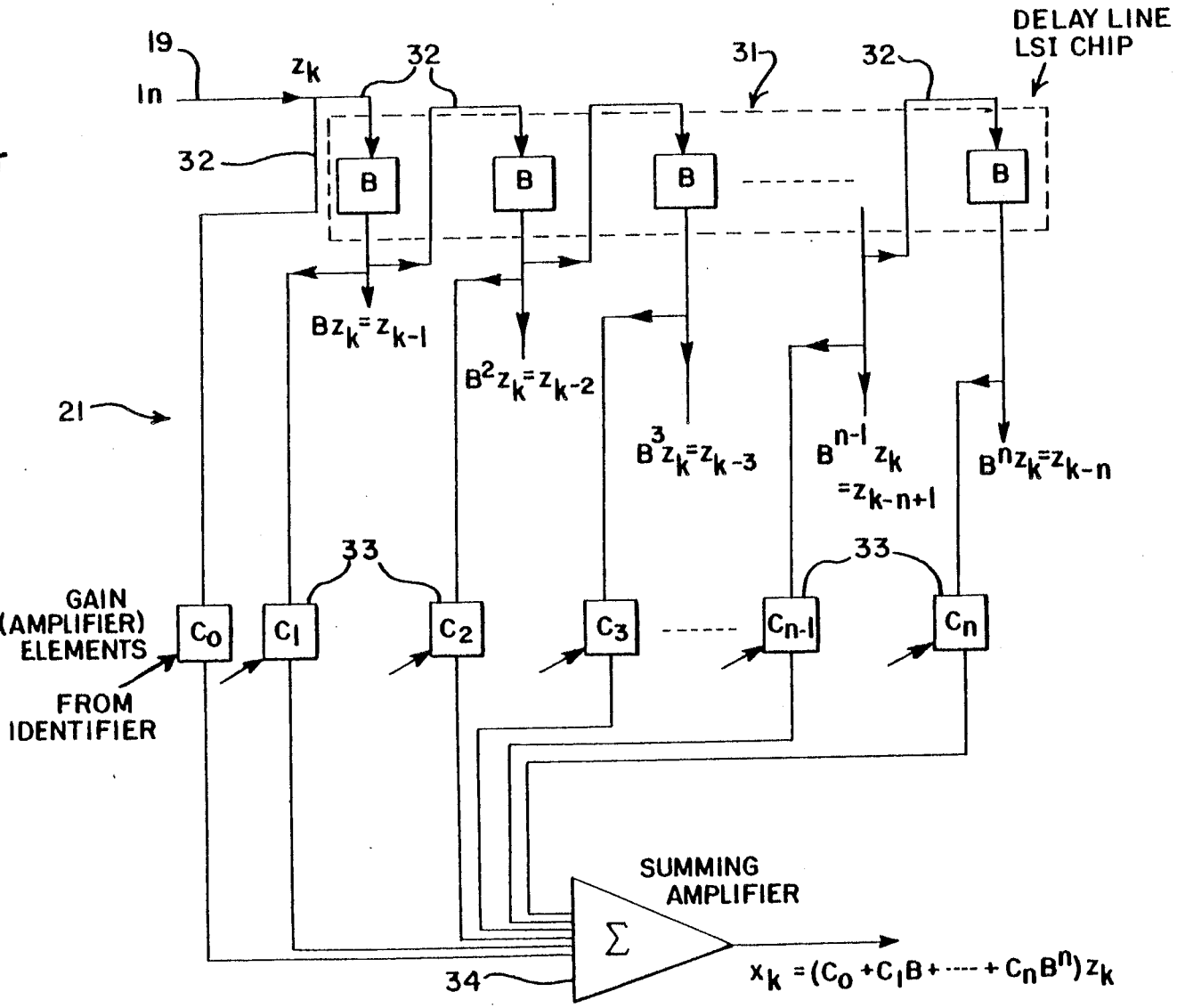
FIG. 4 is a schematic diagram showing a cancellation circuit of the system.

One possible realization of C(B) is in terms of a variable gain digital filter, known as a finite impulse response filter, which may be a single LSI chip as shown in FIG. 4 where the input to C(B) is denoted as $z_k$ and its output as $x_k$. With reference to FIGS. 1 and 4, the combination signal from the amplifier 16 is fed to the input 19 of a delay line LS1 chip 31 which divides the incoming signal into a plurality of increments 32, successive increments being delayed. Variable gain amplifiers 33 receive the time delayed increments and the outputs of the amplifiers 33 are fed to a summing amplifier 34 which produces the anti-noise signal $x_k$. The μp 14 is connected to the amplifiers 33 and controls the gains of the amplifiers and thereby the volume of each delayed increment of the residual noise signal $z_k$ of the environment 11. The μp 14 is programmed to be periodically (for example, 1000 times/second) updated and recalculate the value Ψ(B). The system is therefore self adjusting.

Figure 2:
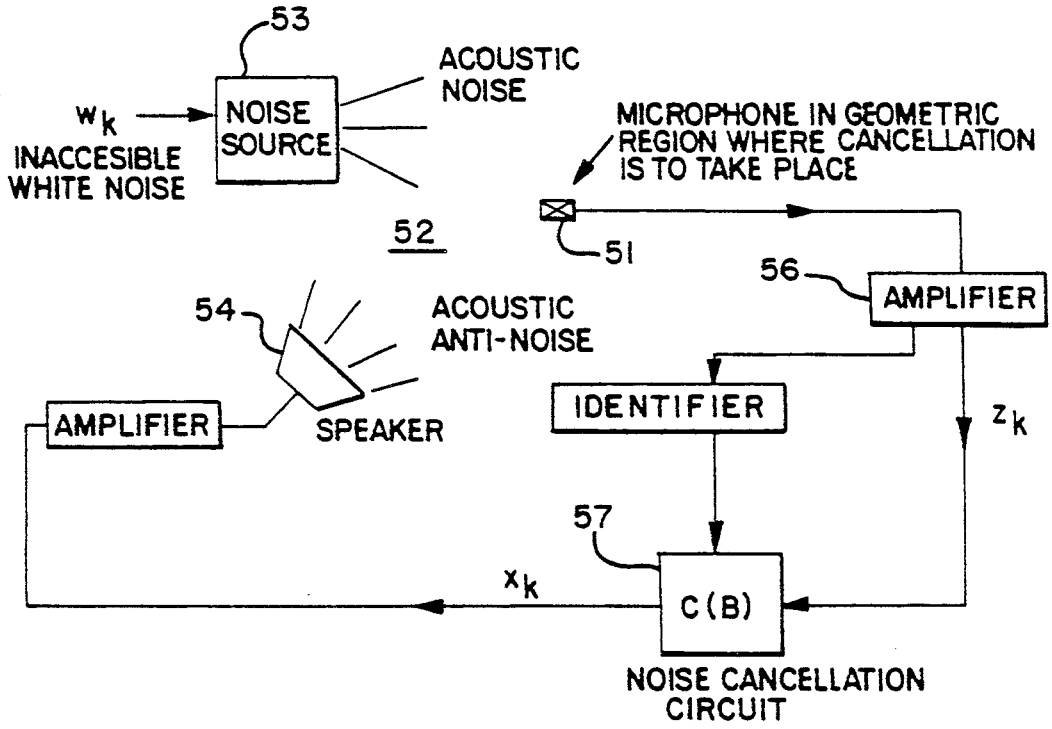
FIG. 2 is a schematic diagram showing an alternative form of the system.

FIG. 2 illustrates an alternative system utilizing only a single microphone 51 which is located in the environment 52 adjacent to both a noise source 53 and an anti-noise speaker 54. In this example the noise signals $n_k$ and $y_k$ are not explicit or separate, but only their sum is picked up by the microphone 51. The microphone output is amplified at 56 and fed to a noise cancellation circuit 57 which drives the anti-noise speaker 54.

FIG. 3 shows a more generalized version of the system of FIG. 1. In FIG. 3, the box 61 includes the components 17, and 24 of FIG. 1, and the box 62 includes the components 10, and 13 in FIG. 1. The remaining components are essentially the same in the two figures.

With regard to the principle of operation of the system shown in FIGS. 1 and 3, the noise signal $n_k$ satisfies the relation $$n_k = \Psi(B)\, w_k \quad (6)$$

$w_k$ being white noise and Ψ(B) being a polynomial in B namely $$\Psi(B) = 1 + \Psi_1 B + \Psi_2 B^2 + \ldots \quad (7)$$

to yield a moving average (MA) model for $n_k$ or a ratio of polynomials in B:

$$\Psi(B) = \frac{\beta_0 + \beta_1 B + \beta_2 B^2 + \ldots}{\alpha_0 + \alpha_1 B + \alpha_2 B^2 + \ldots} \quad (8)$$

to yield a mixed autoregressive-moving average (ARMA) model for $n_k$ or an inverse polynomial in B:

$$\Psi(B) = \frac{1}{\gamma_0 + \gamma_1 B + \gamma_2 B^2 + \ldots} \quad (9)$$

to yield a pure autoregressive (AR) model for $n_k$. The signal $z_k$ at the summation output satisfies:

$$Z_k = n_k - y_k \quad (10)$$

where $y_k$ is the output of the cancellation loop, namely the anti-noise signal, which satisfies, if one follows along the loop:

$$y_k = C(B)G(B)z_k \quad (11)$$

C(B) being the transfer function of the adjustable cancellation network 21, whereas G(B) represents all fixed elements in the loop and which are required to physically produce the anti-noise signal.

Substituting for $n_k$ and $y_k$ from (6) and (11) respectively, $z_k$ satisfies:

$$z_k = -G(B)C(B)z_k + \Psi(B)w_k \quad (12)$$

namely $$[1 + G(B)C(B)]z_k = \Psi(B)w_k \quad (13)$$

such that $$z_k = \left[\frac{\Psi(B)}{1 + G(B)C(B)}\right] w_k \quad (14)$$

Furthermore, in order that $z_k$ be driven towards the white noise $w_k$ the square parentheses of relation (14) must be ±1. For the latter term to be ±1, C(B) must be tuned to equal $$C(B) = \frac{\Psi(B) - 1}{G(B)} \quad (15)$$

such that for any changes in $n_k$ as reflected by changes in $\Psi(B)$, the transfer function of the cancellation network C(B) will be tuned or retuned according to relation (15). Once $z_k$ becomes white noise $w_k$ the difference between $n_k$ and $y_k$ reaches its minimum variance values [see Chapter 4 of the aforementioned text book by D. Graupe] to yield minimum variance cancellation of $n_k$.

A realization of C(B) to satisfy relation (15) is obtained by constructing C(B) as an array of analog or digital unit time delays, each with its appropriate gain, as in FIG. 4, to satisfy any $$C(B) = C_0 + C_1B + C_2B^2 + \ldots \quad (16)$$

where $C_0$, $C_1$, $C_2$. . . are set to satisfy relation (15) above. A rational polynomial for C(B), namely $$C(B) = \frac{\eta_0 + \eta_1 B + \eta_2 B^2 + \ldots}{\phi_0 + \phi_1 B + \phi_2 B^2 + \ldots} = C_0 + C_1 B + C_2 B^2 + \ldots \quad (17)$$

where $\eta_0$, $\eta_1$, $\eta_2$, . . . satisfy $C_0$, $C_1$, $C_2$, . . . and thus satisfying the relation of equation (15) is equally possible. A digital computer or microcomputer realization of equation (16) or (17) is also possible as is the continuous time equivalent of C(B), noting the B operator relates to the Z transform operator (see for example K. Ogata, Modern Control Theory, Prentice Hall Publishing Co., Englewood Cliffs, N.J. 1970) via $$B = Z^{-1} \quad (18)$$

and that a continuous time realization of C(B) thus requires an inverse Z transform of $C(B) = C(Z^{-1})$ into the continuous time (s-operator, namely Laplace operator domain), according to, for example, the above K. Ogata book.

In the foregoing example shown in FIG. 2 or FIG. 3 where the noise cancellation circuit receives the sum of the two noise sources, $$z_k = n_k + y_k \quad (19)$$

where $z_k$ is driven towards a white noise residual as previously described. In this situation, $$z_k = n_k + y_k = \Psi(B)w_k + G(B)C(B)z_k - (20)$$

whereby the setting for C(B) is given by $$C(B) = \frac{1 - \Psi(B)}{G(B)} \quad (21)$$

In summary, the subject matter of this invention is a self-adaptive noise cancellation system that may be employed in a noisy environment at the vicinity of an acoustic noise source to produce noise signals denoted as anti-noise signals that are directed towards a geometric region of the same environment and which counter the first acoustic noise source thus rendering the geometric region relatively quiet. The system of this invention monitors the first acoustic noise source to identify its signal parameters thus retrieving the noise parameters that are required for the device to tune itself in order to cope with variations in the parameters of the noise source and to adapt its own anti-noise output to keep adequate noise cancellation in the geometric region in the face of the changes in the characteristics of the first noise source, such as changes in power or in frequency spectrum of the first noise source.

What is claimed is:

1. A noise cancellation system for use in connection with a noise source which creates a noise environment, said system comprising:
   a) first microphone means adapted to be positioned in said noise environment and to pick up noise from said source;
   b) a loudspeaker adapted to be positioned adjacent said noise environment and to project acoustic anti-noise into said noise environment;
   c) second microphone means adapted to be positioned in said noise environment and to pick up said acoustic anti-noise;
   d) noise cancellation circuit means connected to drive said loudspeaker and having first and second inputs;
   e) combining means connected to receive the outputs of said first and second microphone means and form a combination signal which is connected to said first input; and
   f) stochastic identifier means connected to receive the uninverted output of said first microphone means and whose output is connected to said second input of said noise cancellation circuit, the identifier's output being a set of stochastic parameters that characterize said noise source.

2. A system as set forth in claim 1, wherein said first microphone means comprises an array of first microphones adapted to be positioned in said noise environment, each of said first microphones being connected to said identifier means and said identifier means combining the outputs of said first microphones.

3. A system as set forth in claim 1, wherein said combining means forms the difference between said outputs of said first and second microphone means.

4. A system as set forth in claim 1, wherein said combining means forms the sum of said outputs of said first and second microphone means.

5. A system as set forth in claim 1, wherein said noise cancellation circuit means comprises a plurality of delay elements each connected to an amplifier.

6. A system as set forth in claim 5, wherein said delay elements comprise analog delay elements.

7. A system as set forth in claim 5, wherein said delay elements comprise digital delay elements.

8. A system as set forth in any of claims 1 to 4, wherein said noise cancellation circuit means is formed by a digital computer.

9. A system as set forth in any of claims 1 to 4, wherein said noise cancellation circuit means is formed by a variable gain finite or infinite impulse response filter.

10. A noise cancellation system for use in connection with a noise $n_k$ environment, said system comprising:
   a) first microphone means adapted to be positioned in said noise environment and to pick up noise $n_k$ from said source;
   b) a loudspeaker adapted to be positioned adjacent said noise environment and to project acoustic anti-noise into said noise environment;
   c) second microphone means adapted to be positioned in said noise environment and to pick up said acoustic anti-noise and produce an anti-noise signal $y_k$;

d) noise cancellation circuit means producing an output signal $x_k$ connected to drive said loudspeaker and having first and second inputs;

e) means connected to receive the outputs of said first and second microphone means and form a combination signal $z_k$ which is connected to said first input;

f) stochastic identifier means connected to receive the uninverted output of said first microphone means and connected to said second input of said noise cancellation circuit and producing a set of stochastic parameters;

g) wherein said noise cancellation circuit means has a time transfer function C(B), wherein B is a unit delay operator, and is automatically and repeatedly set and reset to satisfy the relation $$C(B) = \frac{\pm\Psi(B) - 1}{G(B)} \quad (1)$$

where G(B) is a transfer function denoting the acoustic environment between said loudspeaker and said second microphone means and Ψ(B) is a transfer function that gives rise to the noise signal $n_k$ to be cancelled as detected by said first microphone means, the latter transfer function relating $n_k$ with a generation function defined as $w_k$ and which has properties of white noise the value of Ψ(B) being computed by said identifier means according to the relation $$n_k = \Psi(b)\, w_k \quad (2)$$

where k denotes discrete times such that k=0, 1, 2, . . . .

11. A system according to claim 10, wherein $w_k$ is the inaccessible white noise defined to satisfy the relation $$E\{w_k\} = 0 \forall k \quad (3)$$

$$E\{w_k w_1\} = \begin{cases} W & k = 1 \\ 0 & k \neq 1 \end{cases} \quad (4)$$

wherein E denotes an expectation of the term inside the curly brackets next to E and where the value G(B) may be identified from relations of input and output of said speaker and said second microphone means by a separate circuit for identifying G(B) or alternatively where G(B) is present, and where a parameter setting circuit is input with the identified values of Ψ(B) and G(B) to repeatedly re-evaluate C(B) from equation (1) above to set the value of the transfer function of the cancellation network to satisfy equation (1) thus updating C(B) for possible changes in Ψ(B) and/or in G(B), such that the system drives the difference $z_k$ between the noise to be cancelled $n_k$ and the output $y_k$ of the correction loop comprising of the cascade G(B) and C(B) to white noise $w_k$ which is the minimum variance of any linear predictor of the noise $n_k$ since by following the correction loop, the said difference $z_k$ satisfies:

$$z_k = n_k + y_k \quad (5)$$

whereas, by following the correction loop comprising of the cascade of C(B) and G(B) and whose input is $z_k$, $y_k$ satisfies $$y_k = C(B)G(B)\, z_k \quad (6)$$

while, by the definition of the transfer function that gives rise to the noise $n_k$, said $n_k$ is given by $$n_k = \Psi(B) w_k \quad (b\ 7)$$

therefore, substituting in (5) for $y_k$ from (6) and for $n_k$ from (7), $z_k$ satisfies $$z_k = G(B)C(B)z_k + \Psi(B)w_k \quad (8)$$

such that $$[1 - G(B)C(B)]z_k = \Psi(B)w_k \quad (9)$$

which results in that for $z_k$ to be driven towards $\pm w_k$, C(B) must satisfy that of equation (1) which is the tuning relation of (2) according to which C(B) is turned to cope with variations in Ψ(B).

12. A noise cancellation system for use in connection with a noise source including noise $w_k$ which creates a noise $n_k$ environment, said system comprising:

a) a loudspeaker adapted to be positioned adjacent said noise environment and to project acoustic anti-noise into said noise environment;

b) microphone means adapted to be positioned in said noise environment and picks up the sum $z_k$ of the acoustic output $n_k$ of said noise source and the acoustic output $+y_k$ of said amplifier such that $$z_k = n_k + y_k = \Psi(B)w_k + G(B)C(B)z_k \quad (1)$$

and $$C(B) = \frac{1 - \Psi(B)}{G(B)} \quad (2)$$

c) noise cancellation circuit means producing an output signal $x_k$ connected to drive said loudspeaker and having first and second inputs, said first input being connected to said microphone means;

d) stochastic identifier means connected to said microphone means and to said second input of said noise cancellation circuit and producing a set of stochastic parameters:

e) wherein said noise cancellation circuit means has a time transfer function C(B), wherein B is a unit delay operator, and is automatically and repeatedly set and reset to satisfy said equation (2)

where G(B) is a transfer function denoting the acoustic environment between said loudspeaker and said microphone means and Ψ(B) is a transfer function that gives rise to the noise signal to be cancelled as detected by said first microphone means, the value of Ψ(B) being computed by said identifier means according to the relation $$n_k = \Psi(B)w_k \quad (3)$$

where k denotes discrete times such that k=0, 1, 2, . . . .

* * * * *